United States Patent [19]

Loix

[11] 4,315,389

[45] Feb. 16, 1982

[54] SELF-SUPPORTING OUTER METALLIC STAIRWAY

[76] Inventor: Gilbert L. Loix, Chaussee Brunehault 22, 4462 Juprelle-Wihogne, Belgium

[21] Appl. No.: 119,785

[22] Filed: Feb. 8, 1980

[30] Foreign Application Priority Data

Feb. 9, 1979 [BE] Belgium ..... 874 067

[51] Int. Cl.[3] ..... E04F 11/00

[52] U.S. Cl. ..... 52/185; 52/187; 182/115

[58] Field of Search ..... 52/182, 185, 188, 191, 52/187, 184; 182/48, 115

[56] References Cited

U.S. PATENT DOCUMENTS

| | | | |
|---|---|---|---|
| 2,377,994 | 6/1945 | Cocken, Jr. | 52/182 |
| 3,052,332 | 9/1962 | Mulitz | 52/185 |
| 3,175,654 | 3/1965 | Calvert | 52/185 X |
| 3,228,154 | 1/1966 | Mulitz | 52/185 |
| 3,670,848 | 6/1972 | Raiguel, Jr. | 52/185 |
| 3,707,814 | 1/1973 | Seegers | 52/185 |
| 3,765,137 | 10/1973 | Loix | 52/182 |
| 3,927,518 | 12/1975 | Simmons et al. | 52/185 X |
| 4,098,036 | 7/1978 | Spöler et al. | 52/184 X |

FOREIGN PATENT DOCUMENTS

| | | | |
|---|---|---|---|
| 520293 | 11/1977 | U.S.S.R. | 52/185 |

*Primary Examiner*—Price C. Faw, Jr.
*Assistant Examiner*—Carl D. Friedman
*Attorney, Agent, or Firm*—Robert E. Burns; Emmanuel J. Lobato; Bruce L. Adams

[57] ABSTRACT

The outer metallic stairway, particularly made of aluminium, for multistage buildings or buildings of a rather important height, to be used for allowing the occupants of a multistage building to evacuate this one is essentially fixed and supported by means of four uprights forming a column of support that are mounted vertically in a square or rectangular arrangement, the flights of stairs being fixed to at least two of the sides of the support column, the uprights being connected to one another at different levels and at least on the level of the landings by means of four horizontal tie-bars, one of which on a level with a story landing being extended beyond a second upright for supporting said landing on a whole side or to be fixed to an existing landing and to support the flight of stairs fixed to it that descends from said landing, and two of the four tie-bars that are provided on the level of an intermediate landing being extended beyond one of the uprights in order to form a part of the supporting frame of an intermediate landing, the flight of stairs descending from said intermediate landing being fixed to one of said two extended tie-bars.

14 Claims, 17 Drawing Figures

18
8
9
8

SELF-SUPPORTING OUTER METALLIC STAIRWAY

BACKGROUND OF THE INVENTION

The present invention relates to an outer metallic stairway, particularly made of aluminium, for multistage buildings or buildings of a rather important height, said stairway being generally intended to be used for allowing the occupants of a multistage building to evacuate this one and persons to go out and/or to go in by an outside means, and being designed in such a manner as to be essentially self-supporting so that it may be provided for a multistage building to be erected; the stairway is also particularly useful in the case of a multistage building already existing which is to be provided with an evacuation facility or an outside outlet, i.e. it may be adapted to a multistage building formerly constructed. The stairway in accordance with the present invention is only to be attached against a main wall, for example the front wall of the building without being hooked to the wall of the building, i.e. without being carried by said wall.

Outer stairways of rather numerous various types have a course already been proposed. The known stairways are either made of elements that are independant of one another from story to story and are carried by the front wall of the building except the lowest one or they are made of elements that are connected with one another, the whole or nearly the whole of the stairway being supported by the front wall of the building at different points of the height of the stairway and as a rule at least at one point per story so that an important work is to be carried out for fixing the stairway to the front wall of the building. There are also stairways that may be regarded as self-supporting and that are real metallic columns with the stairway rising inside.

SUMMARY OF THE INVENTION

The outer metallic stairway in accordance with the present invention has none of the above-mentioned drawbacks. Said stairway is of a quite new design and a feature of interest thereof is that it will be entirely constructed on the shop and will be mounted in situ on a very simple way without requiring any welding work. The assembly is carried out without using any scaffolding and consists in a simple fitting of elements one into the other, which elements may be bolted or riveted together. Though most of the constituent elements therof are standardized, the stairway may be adapted to story heights that are different of the standard story heights (for example different of the current flat story height of 2.75 m of a private building) and it may thus be used in the case of old constructions, public buildings, industrial buildings and so on. It is moreover possible to increase or reduce the depth, i.e. the distance between the outer side of the stairway and the wall against which it is placed. On the other hand, the stairway is also designed in such a manner that it may be transported and shipped or forwarded as a noncumbersone mass, the component parts thereof, of a particularly reduced size, being separated.

For this purpose, the outer metallic stairway in accordance with the present invention, particularly made of aluminium, for multistage buildings or buildings of a rather important height, which is generally intended to be used for allowing the occupants of a multistage building to evacuate this one and persons to go out and/or to go in by an outside means so characterized in that it is essentially fixed and supported by means of four uprights forming a column of support that are mounted vertically in a square or rectangular arrangement, the flights of stairs being fixed to at least two of the sides of the support column, the uprights being connected to one another at different levels and at least on the level of the landings by means of four horizontal tie-bars, one of which on a level with a story landing being extended beyond a second upright for supporting said landing on a whole side or to be fixed to an extending landing and to support the flight of stairs fixed to it that descends from said landing, and two of the four tie-bars that are provided on the level of an intermediate landing being extended beyond one of the uprights in order to form a part of the supporting frame of an intermediate landing, the flight of stairs descending from said intermediate landing being fixed to one of said two extended tie-bars.

In accordance with a preferred embodiment of the present invention, the assembly of the different elements that will form the stairway is carried out by a process consisting of partially fitting certain of said constituent elements into one another, partially bolting and partially riveting elements to one another, and all said constituent elements may be machined and cut at the required size in the workshop.

BRIEF DESCRIPTION OF THE DRAWINGS

To provide a clearer understanding of the present invention as well as the characterisitics and benefits thereof, a description is given below with reference to the accompanying drawings that illustrate by way of non limiting example a self-supporting outer metallic stairway in accordance with the invention.

In said drawings.

DESCRIPTION OF PREFERRED EMBODIMENT

Figure 1:
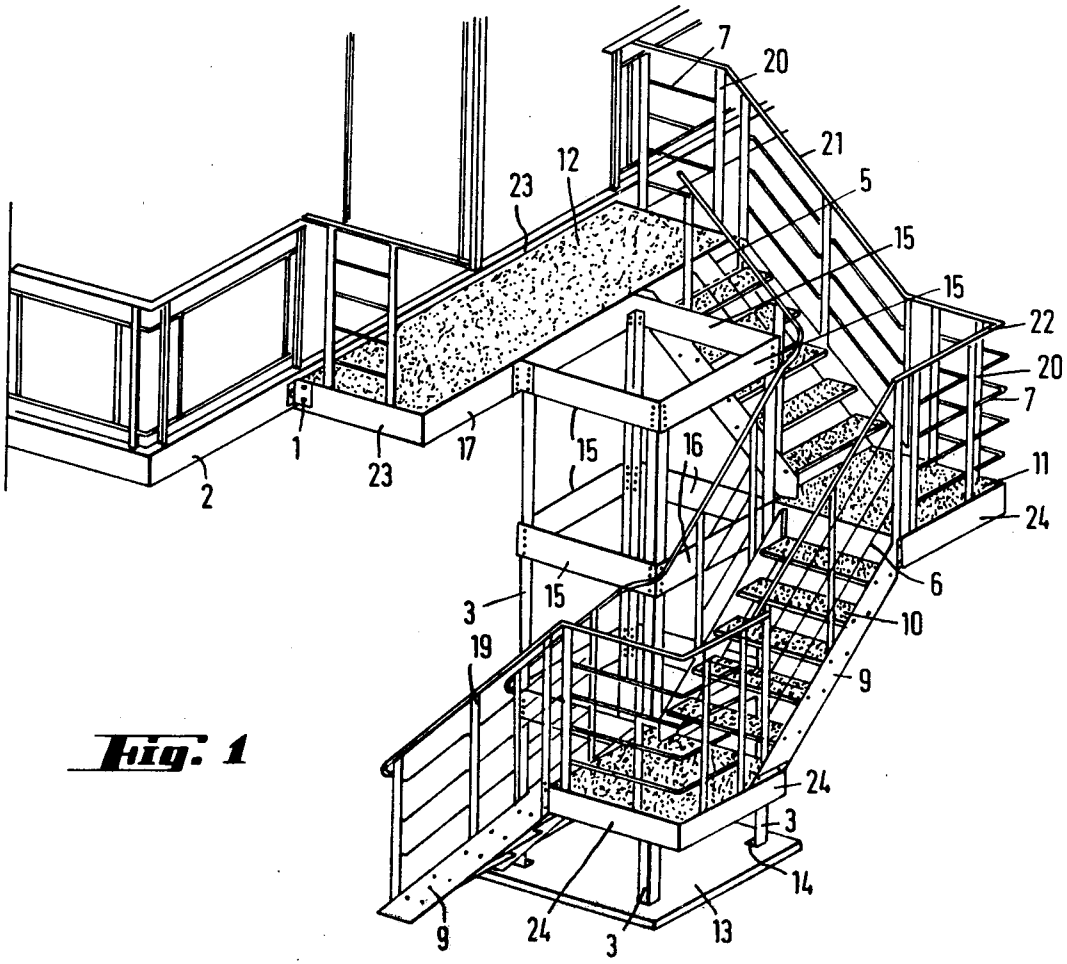
FIG. 1 is a general diagrammatic perspective view, in situ, of that part of a stairway in accordance with the present invention that leads to the second floor of a building, said view being limited to said first part of the stairway.
Figure 2:
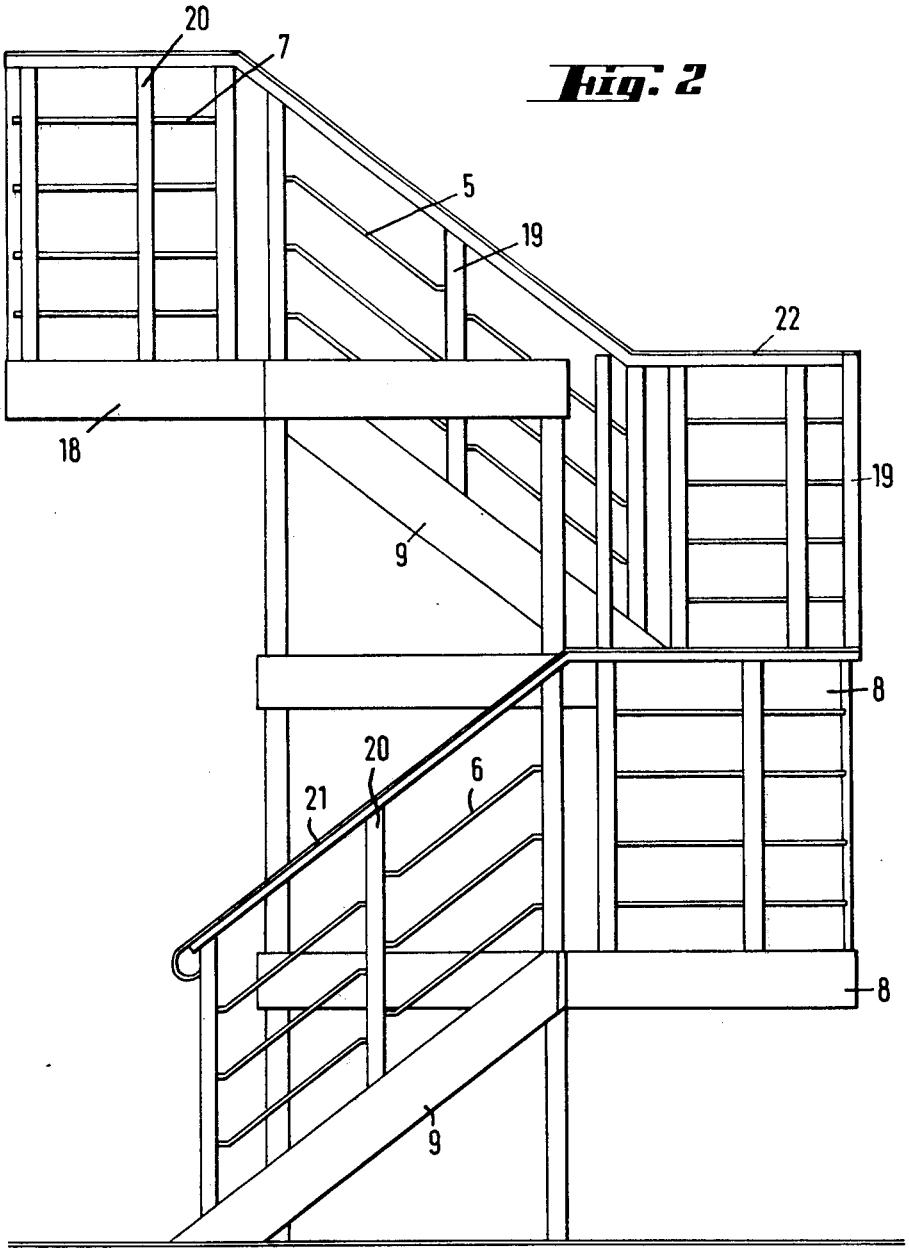
FIG. 2 is a diagrammatic side view that represents only the part of a stairway in accordance with the present invention that is comprised between two floors.
Figure 3:
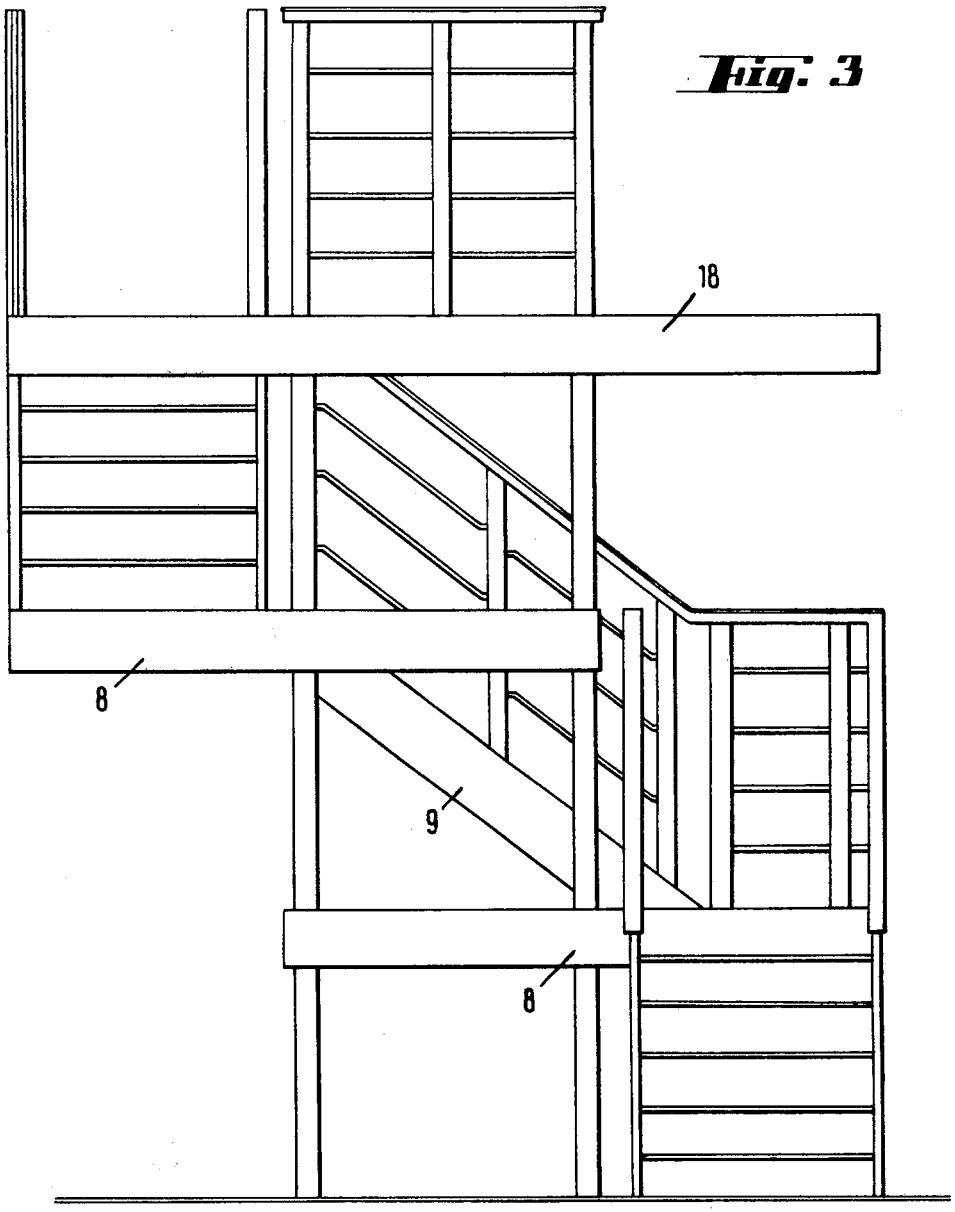
FIG. 3 is a diagrammatic side view of that part of the stairway that is shown on FIG. 2, but seen here from the side of the stairway bearing on the wall of the building.
Figure 4:
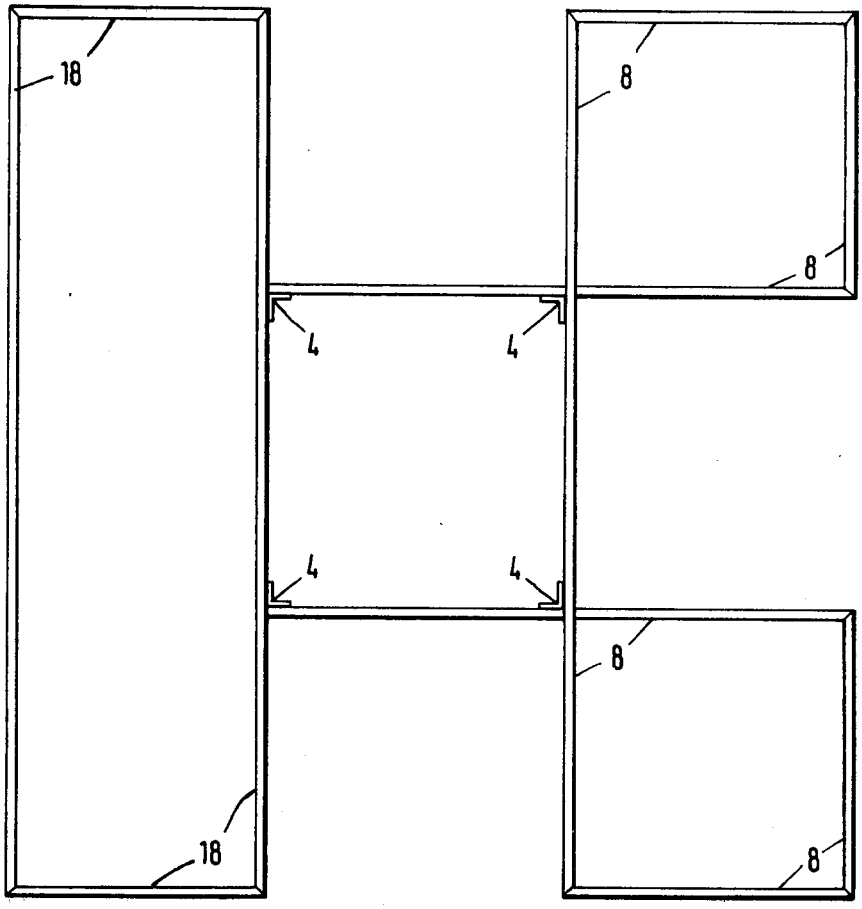
FIG. 4 is a diagrammatic plane view showing the arrangement of the constituent elements that will form the supporting frame of a part of the stairway comprised between two floors.

Referring to the different figures and particularly to FIG. 1, the angle-irons fixing the stairway to the main wall, i.e. to the front wall, indicated by the reference numeral 2, of a building (represented diagrammatically by a story of standard construction) are indicated by the reference numeral 1; the uprights intended for forming the column of support indicated by the reference numeral 4 are indicated by the reference numeral 3 (FIG. 4); the transverse elements of the balustrade at the inner side of a flight of stairs are indicated by the reference numeral 5; the transverse elements of the balustrade at the outer side of a flight of stairs are indicated by the reference numeral 6; the transverse elements of the balustrade of a landing are indicated by the reference numeral 7; the supporting frame of an intermediate landing is indicated by the reference numeral 8 (FIG. 4); the stringers of a flight of stairs are indicated by the reference numeral 9; the treads of a flight of stairs are indicated by the reference numeral 10; the floor-plate of an intermediate landing is indicated by the reference numeral 11; the floor-plate of a story landing is indicated by the reference numeral 12; the base-plate on which the column of support 4 (uprights 3) rests and to which said column of support is fixed is indicated by the reference numeral 13; the angle-irons used for fixing the uprights 3 to the base-plate 13 are indicated by the reference numeral 14; the three horizontal tie-bars that surround the uprights 3 forming the column of support and that are not extended beyond said column of support are indicated by the reference numeral 15; the two horizontal tie-bars that are extended beyond an upright 3 of the column of support 4 and that form a part of the supporting frame 8 of an intermediate landing are indicated by the reference numeral 16; the horizontal tie-bar that is extended beyond two uprights 3 of the column of support 4 and that forms a part of the supporting frame, indicated by the reference numeral 18 (FIG. 4) of a story landing is indicated by the reference numeral 17; the uprights to which the transverse elements 5, 6 of the balustrades of the flight of stairs are fixed, are indicated by the reference numeral 19; the uprights to which the transverse elements 7 of the balustrades of the landings are fixed are indicated by the reference numeral 20; the hand-rails of the balustrades of the flights of stairs are indicated by the reference numeral 21; the hand-rails of the balustrades of the landings are indicated by the reference numeral 22; the complementary horizontal tie-bars of the supporting frame 18 (FIG. 4) of a story landing are indicated by the reference numeral 23, and the complementary horizontal tie-bars of the supporting frames 8 (FIG. 4) of the intermediate landings are indicated by the reference numeral 24. FIGS. 2, 3 and 4 illustrate more particularly the general principle of the self-supporting system of the stairway, carried by the column of support 4 (upright 3) that supports, from bottom to top (for a part of the stairway that covers only the height of a story, as shown in the drawings), the supporting frame 8 of the lowest intermediate landing to which the first upward flight of stairs is fixed, the supporting frame 8 of the upper intermediate landing to which the second upward flight of stairs is fixed and the supporting frame 18 of the story landing to which the third upward flight of stairs is fixed.

Though the column of support 4 in the case of the embodiment illustrated by the drawings is of square cross-section, it will be easily understood that it could have a rectangular cross-section, in which case a flight of stairs will have a height different of that of the other flights of stairs. By increasing or reducing the dimensions of the square or of the rectangle representing the cross-section of the column of support 4, thus reducing or increasing the height of the flights of stairs, the various modifications that may be made in this way will easily enable to adapt the stairway to any provided story height of a building to be erected or of an already existing building, without being necessary to modify the slope of the flights of stairs, which of course represents also a possibility of adaptation (rather slight) to different heights; notable feature of the present invention is that the result may be obtained by only modifying the dimensions (width and length) of the cross-section of the support column 4 without having to modify the standard distance between the treads that has initially been chosen.

The dimensions (width and length) of the cross-section of the support column 4 as well as the square or rectangular cross-section of said column of support may of course be chosen on account of other reasons, as for instance aesthetics or available ground space; thus for a same height of story, it is possible by choosing a rectangular cross-section of the support column rather than a square one—the length plus the width of the rectangle being equal to twice the side of the square—to increase or to reduce the over-all distance between the front wall of the building ant the outer side of the stairway.

Though there are provided as a rule two intermediate landings and three flights of stairs between two story landings (or between the ground level or first floor and the second floor), it may be necessary, in the case of public or industrial buildings), to provide again after the third flight of stairs an intermediate landing (that will replace the normal story landing) and then the intermediate landings and the three flights of stairs before again a story landing (arranged for instance on the four sides of the support column); on the other hand, in the case of a rather low story height, there will be from top to bottom a story landing, a flight of stairs, an intermediate landing and then another flight of stairs directly leading to a story landing.

Referring more particularly to FIGS. 5 to 14, the different elements constituting the stairway will be described in a more detailed way, as well as the preferential mounting, the used sections and the means intended for assembling and fitting together the different elements; a notable advantage and a feature of the present invention is that the assembling and fitting together of the constituent elements may be carried out in situ and easily, without welding work, by a simple fixing to the wall that aims only to maintain the whole stairway against the wall, the parts that are successively mounted upwardly from bottom serving as a stairway for carrying on the mounting toward the top.

Figure 5:
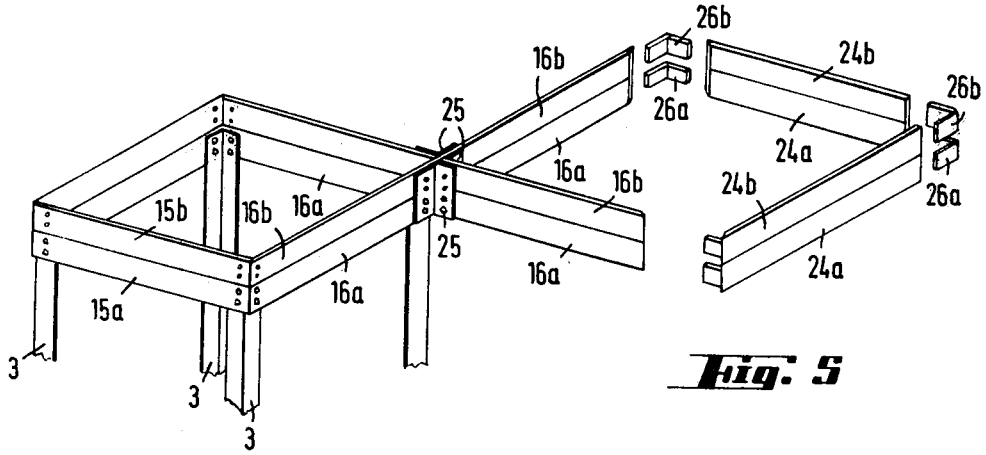
FIG. 5 is a diagrammatic partial view, to an enlarged scale, that shows details of the assembly of the supporting frame.

FIG. 5 illustrates the assembly of the support column 4 which is formed of successive sets of four uprights 3 the cross-section of which is right-angled, at the upper end of which are fixed by means of bolts the lower parts indicated by the reference numeral 15*a* of the normal horizontal tie-bars 15 or the lower parts indicated by the reference numeral 16*a* of the horizontal tie-bars 16 that are extended on one side, the tie-bars being all constituted by two hollow sections that are partially fitted in each other (the same is true for the tie-bars 17 which are extended beyond two uprights 3); inversely, the upper parts indicated by the reference numerals 15*b*, 16*b* and 17*b* of the respective tie-bars 15, 16 and 17 are fixed on the lower end of the uprights 3 of the next set of uprights (which is not shown on FIG. 5). At the crossing or intersection of the tie-bars 16 that are extended at one end beyond an upright 3—tie-bars 16 that will be later described in a more detailed way with reference to FIG. 6—three corner-plates 25 are fixed by means of bolts to said tie-bars 16 to allow the mounting of the intermediate landing 8 which is formed by the extending portions of the horizontal tie-bars 16 and by complementary horizontal tie-bars indicated by the reference numeral 24, that are also formed of two superimposed parts indicated by the reference numerals 24*a* and 24*b* constituted by two hollow sections that are partially fitted into each other.

Figure 14:
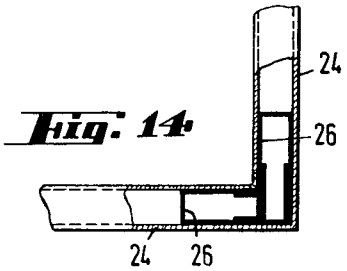
FIG. 14 is a diagrammatic sectional view, partially broken, that represents a detail of the assembly of a corner of a landing supporting frame, said view showing also the constituent elements seen in profile.

As may be seen on the drawings, the horizontal tie-bars, as well tie-bars 15 as tie-bars 16 and 24, and also tie-bars 17 and 23 are all cut to a chamfer at both ends; moreover at the corners where no uprights 3 are provided, two angle-pieces respectively indicated by the reference numerals 26*a* and 26*b* are slid into the lower parts 16*a* and 24*a* of the tie-bars 16 and 24 (as well as into the lower parts 17*a* and 23*a* of the tie-bars 17 and 23, which is not shown in a detailed way in the drawings) or into the two lower parts 24*a* (as well as 23*a*) and into the upper parts 16*b* and 24*b* of the tie-bars 16 and 24, said angle-pieces 26 being fixed by riveting, as may be seen in FIG. 14.

Figure 6:
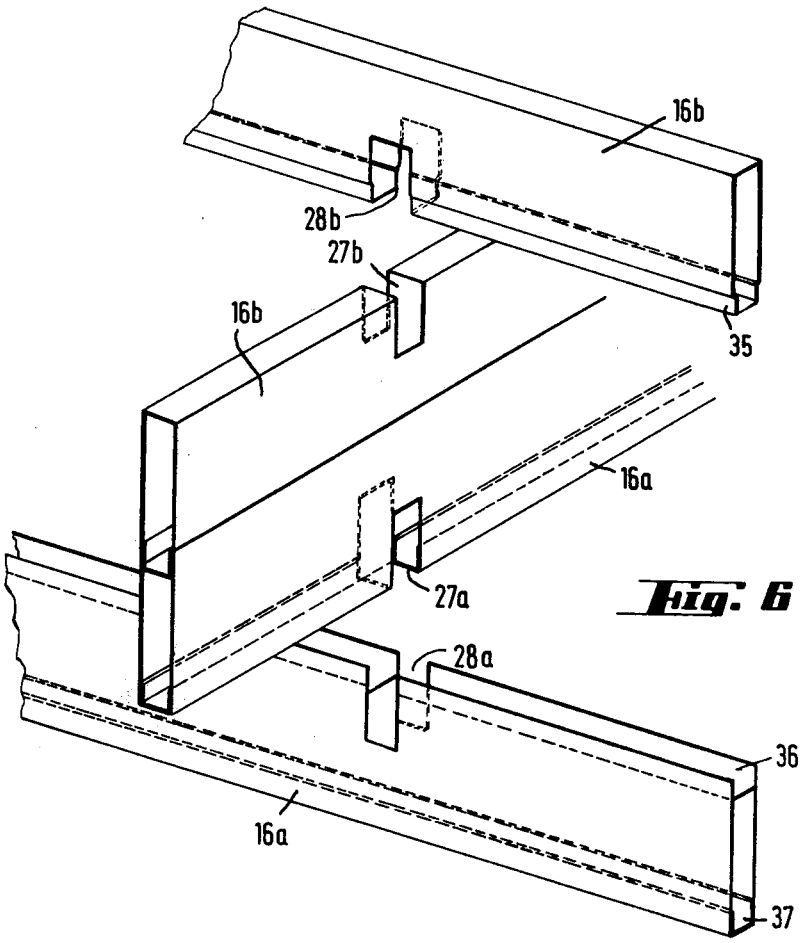
FIG. 6 is a diagrammatic partial view illustrating the assembly of the constituent elements forming the tie-bars and the horizontal supporting frame.

As may be seen in FIG. 6, in order that the horizontal tie-bars 16 that are extended beyond an upright 3 may intersect each other, one of said horizontal tie-bars 16 is provided with a lower upward cut away portion indicated by the reference numeral 27*a* that covers half the height of the lower part 16*a* of said tie-bar and with an upper downward cutaway portion indicated by the reference numeral 27*b* that covers half the height of the upper part 16*b* of said tie-bar; in alignment with said cut away portion 27*a* and 27*b*, the lower part 16*a* of the other tie-bar 16 is provided with an upper downward cut way portion indicated by the reference numeral 28*a* that covers the same height as the cut away portion 27*a*, and the upper part 16*b* of said other tie-bar 16 is correspondingly provided with a lower upward portion indicated by the reference numeral 28*b* that also covers the same height as the cut away portion 27*b* of the first tie-bar 16.

While the first-mentioned tie-bar 16 which is notched at 27*a* and 27*b* as above described, has already its two constituent sections fitted into each other, the second mentioned tie-bar 16 which is notched at 28*a* and 28*b* as above described, has still its constituent sections 16*a* and 16*b* separated from each other and said constituent sections 16*a* and 16*b* of the second mentioned tie-bar are placed astride the first mentioned tie-bar respectively from the bottom and from the top and are then fitted onto said first mentioned tie-bar 16.

Figure 7:
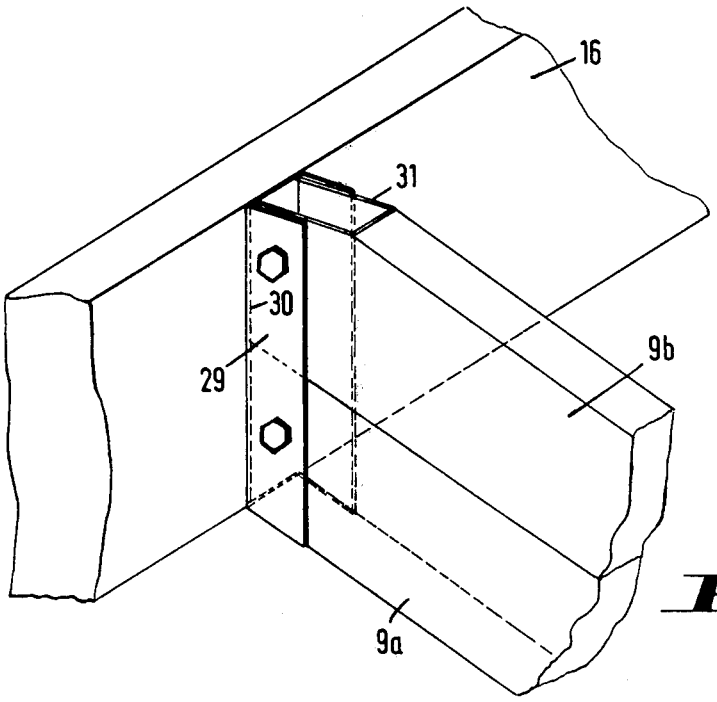
FIG. 7 is a diagrammatic partial view that represents a detail of the fixing of a flight of stairs at the upper part.

FIG. 7 shows how the stringers 9 of a flight of stairs are fixed at the top i.e. at their upper end, said stringers 9 being, as the main tie-bars 15, 16 and 17 and as the complementary tie-bars 23 and 24, formed of two sections respectively indicated by the reference numerals 9*a* and 9*b* that are partially fitted into each other (see FIG. 11), all sections used being identical in order that the manufacturing and the assembling may be rationalized. To the horizontal tie-bar 16 that is extended (or to the tie-bar 17), perpendicularly to the outer side thereof is fixed, for example by welding, a U-shaped element indicated by the reference numeral 29 that is right-angled into which is slid the upper end indicated by the reference numeral 30 of the stringer 9, that is then fixed by means of bolts; said upper end 30 of the stringer 9 is cut slantwise in order that the stringer 9 may have the required slope. In order that the stringer 9 may not project above the U-shaped piece 29, a cut away portion indicated by the reference numeral 31 is provided along a short length of the outer edge of the constituent section 9*b* of the stringer 9 (the constituent section 9*a* of the same may also be provided with such a cut away portion).

Figure 8:
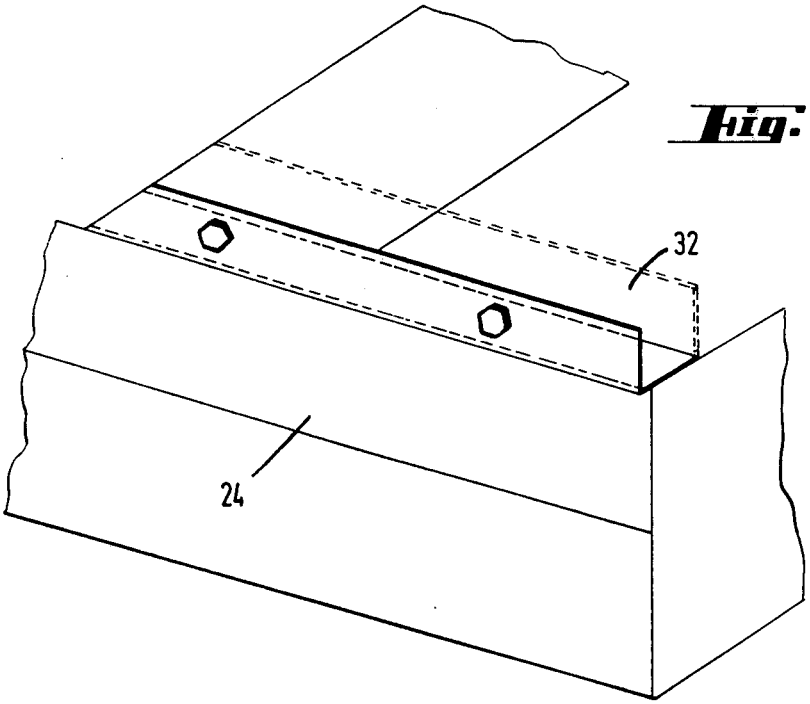
FIG. 8 is a diagrammatic partial view that represents a detail of the fixing of a flight of stairs at the lower part.

FIG. 8 shows how the stringers 9 of a flight of stairs are fixed at the bottom, i.e. at their lower end, at least at the outer side; the flight of stairs may indeed rest at the lower end on the landing, the stringers 9 being only suitably cut slantwise at their lower end for this purpose. However at the outer side the fixation will preferably be carried out as illustrated by FIG. 8; a right-angled U-shaped piece indicated by the reference numeral 32 is fixed (for example by welding) to the upper edge of the tie-bars 24 (which is also the case as regards the tie-bars 23) and the lower end of the stringer 9 suitably cut slantwise is slid into said right-angled U-shaped piece 32 and is fixed to the same by means of bolts.

Figure 9:
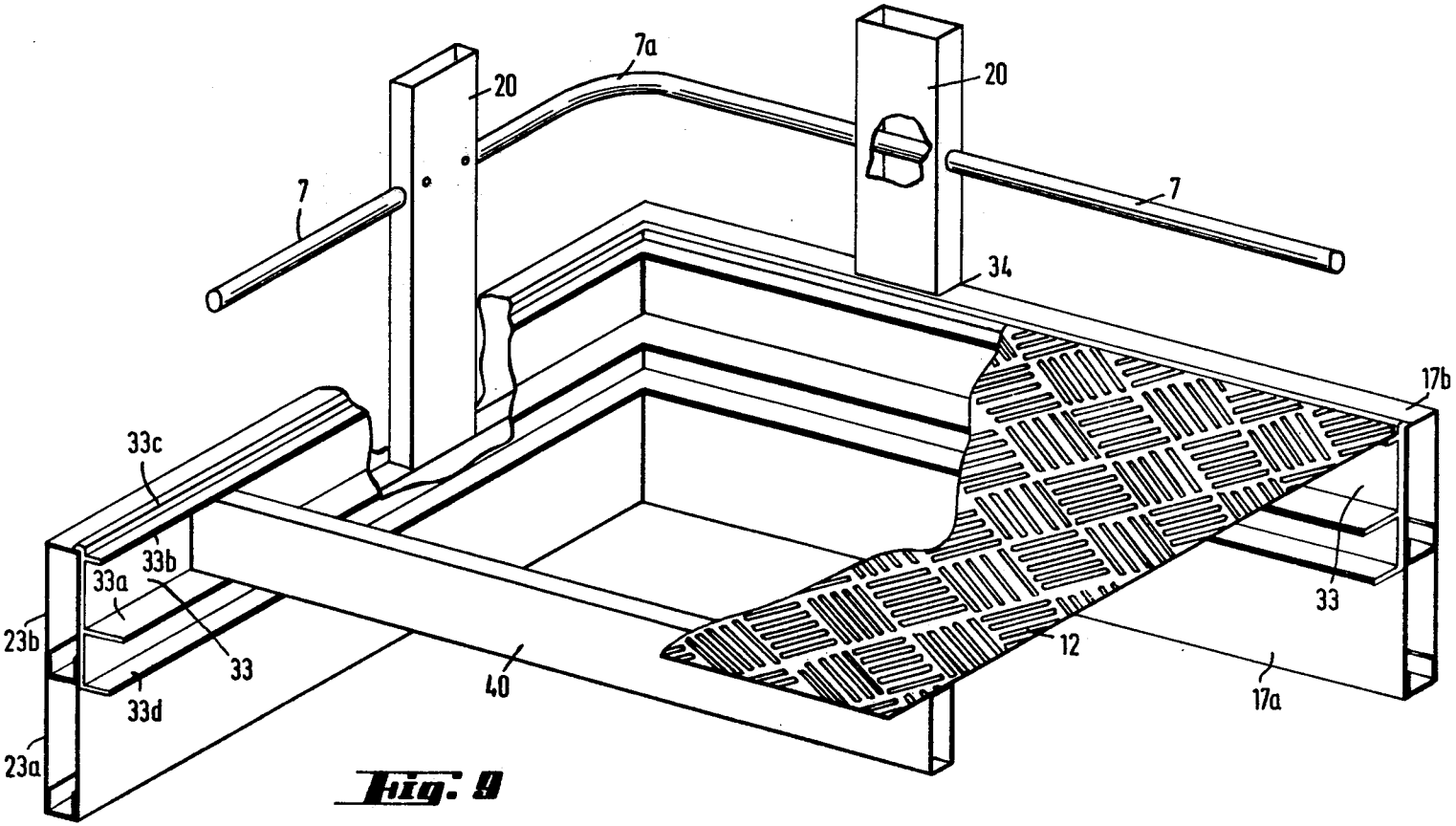
FIG. 9 is a diagrammatic partial view that represents a detail of the assembly of the balustrade, i.e. of the banisters and hand-rails, and of the floor-plate of a landing, said view being partially broken.

FIG. 9 shows in a detailed manner the assembly that is carried out for forming a story landing bearing on the supporting frame 18 (FIG. 4). A right-angled U-shaped element indicated by the reference numeral 33 is fixed (for example by welding) to the inner side of the horizontal extended tie-bar 17 of the support column 4 and to the inner side of the complementary tie-bars 23 (only one of which is shown in FIG. 9) at the level of the upper sections 17*b* and 23*b* respectively of said tie-bars 17 and 23, which will enable to slide perpendicularly between the flangers respectively indicated by the reference numerals 33*a* and 33*b* of said U-shaped element 33 one or more tie-bars indicated by the reference numeral 40 that will form a support for the floor-plate indicated by the reference numeral 12 of a story landing, said floor-plate 12 resting moreover on the outer side of the flange 33*b* of the U-shaped element 33. As may be seen, the web or rear part of the right-angled U-shaped element 33 is preferably slightly extended upwardly and it is provided with a narrow portion indicated by the reference numeral 33*c* that projects outwardly and serves to maintain perfectly the U-shaped element 33. A supporting frame could also be formed of four U-shaped elements 33 that would be fitted into the supporting frame 18 (without being welded or otherwise fixed). Moreover, in order to make the supporting frame formed of the right-angled U-shaped elements 33 more rigid, said U-shaped elements 33 are also extended downwardly and they are provided with a portion indicated by the reference numeral 33*d* that projects inwardly; in the same way, the intermediate landings will be mounted as shown on FIG. 10; the uprights or banisters indicated by the reference numeral 20 of the balustrades of the story landings as well as those of the balustrades of the intermediate landings are simply fitted into the tie-bars 17 and 23 (and/or the tie-bars 16 and 24), a cut away portion indicated by the reference numeral 34 being provided in the upper side of the upper parts 17*b* and 23*b* and/or 16*b* and 24*b* of said tie-bars, the uprights 20 supported in said upper parts being then riveted.

Figure 10:
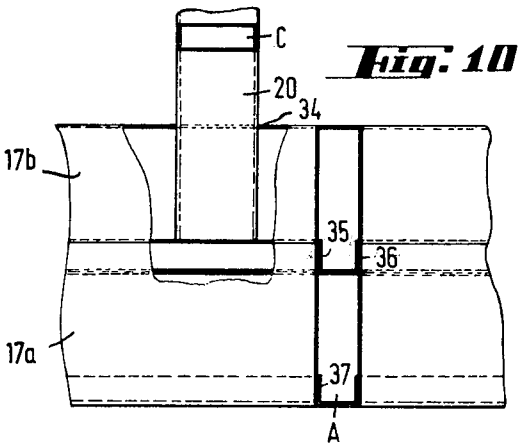
FIG. 10 is a diagrammatic sectional view, partially broken, that represents a detail of the assembly of an upright of a landing balustrade, as well as an elevational view of the constituent elements.
Figure 11:
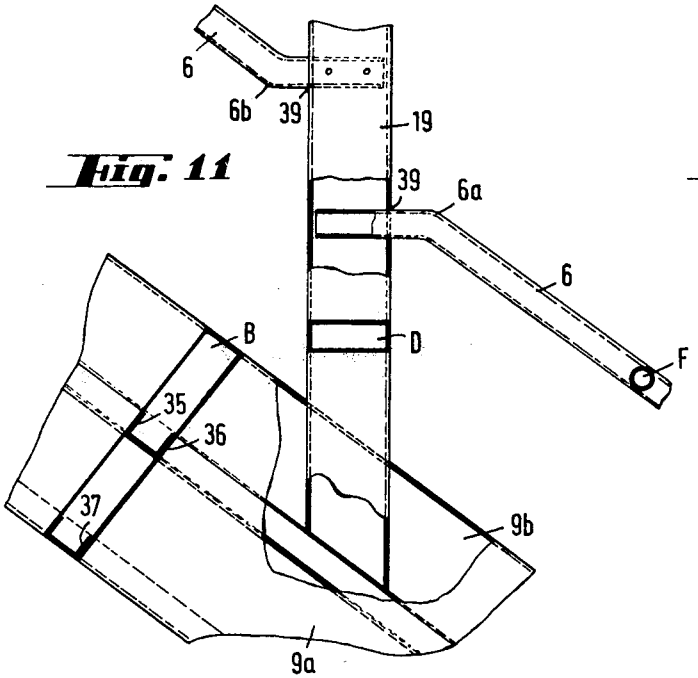
FIG. 11 is a diagrammatic sectional view, partially broken, that represents details of the assembly of the balustrade of a flight of stairs, as well as an elevational view of the constituent elements.

As shown in A in FIG. 10, the parts 17*a* and 17*b* of the tie-bar 17, as the parts 15*a* and 15*b*, 16*a* and 16*b*, 23*a* and 23*b*, and 24*a* and 24*b* of the tie-bars 15, 16, 23 and 24 respectively and as shown in B in FIG. 11, the parts 9*a* and 9*b* of the stringers 9 (identical sections) are formed of tubes a and b having a rectangular cross-section with the longer sides of the rectangle placed vertically, the upper tube b ending at the bottom with a right-angled U-shaped part indicated by the reference numeral 35, the width of which is slightly reduced (see FIG. 6), while the lower tube a is provided at the top with flanges that rise from its lateral sides, thus defining a right-angled channel indicated by the reference numeral 36 into which the right-angled U-shaped part 35 of the upper tube b will fit; moreover, the lower tube a is provided at the bottom with an inner right-angled U-shaped reinforcing part indicated by the reference numeral 37. As may be seen in C in FIG. 10 and FIG. 12, the uprights 20 have a simple rectangular cross-section identical to the cross-section of the uprights 19—see D in FIG. 11—and identical to the cross-section of the tie-bars 40 (FIG. 9). As may be seen on FIG. 10, the uprights 20 are bearing on the ends of the flanges of the U-shaped part 35 of the section 17*b* (or 23*b*, 24*b*, 16*b*).

As shown in FIG. 11, the uprights 19 will be fitted and fixed by riveting in the same way as the uprights 20, at the exception that they will be fitted into the upper part 9*b* of the stringers 9 and their bottom end will be cut slantwise in order to follow the slope of the flight of stairs.

Figure 12:
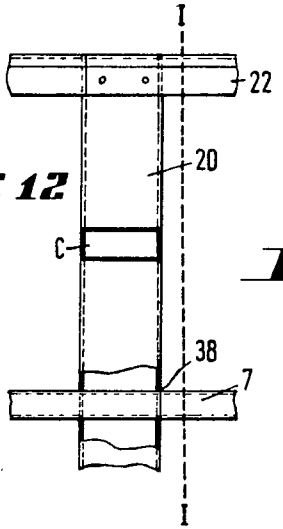
FIG. 12 is a diagrammatic longitudinal section view, partially broken, that represents a detail of the assembly of the balustrade at the level of a landing, as well as an elevational view of the constituent elements.

As shown in FIGS. 9 and 12, the transverse elements 7 of the landing balustrades (which are horizontal) are made of a round tube (the cross-section of which is represented in E in FIG. 13) that passes through holes indicated by the reference numeral 38 in the narrow sides of the uprights 20; the transverse elements 7 that are fixed to the uprights 20 by riveting are bent at the corner of the balustrade.

As may be seen in FIG. 11, the transverse elements 6 (or 5) of the balustrades of the flights of stairs (which are inclined) are made of a round tube (the cross-section of which is represented in F in FIG. 11 and is identical to the cross-section represented in E in FIG. 11 of the tube used for the above-mentioned transverse elements 7), said round tube passing through a hole indicated by the reference numeral 39 in one side of the narrow sides of the uprights 19; as clearly shown in FIG. 11, the upper portion (ending portion) of the transverse elements 6 is bent at 6*a* in order to be horizontal and inversely the lower portion (starting portion) of said transverse elements 6 is bent at 6*b* in order to be horizontal, in such a way that the transverse elements 6 may enter horizontally the holes in the upright 19 to which they are fixed by riveting.

Figure 13:
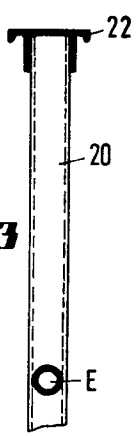
FIG. 13 is a diagrammatic cross-sectional view taken on the line I—I of FIG. 12, i.e. in a plane perpendicular to that of said figure, said view showing the constituent elements seen in profile.

As shown in FIG. 12 and FIG. 13, the hand-rails 22 are made of an element having a right-angled ⅄-shaped profile that is placed astride the head of the uprights 20, to which it is fixed by riveting. The hand-rails 21 that are placed on the uprights 19 are designed and mounted in the same way as the above-mentioned hand-rails 22 (which is not shown in a detailed way in the drawings).

Figure 15:
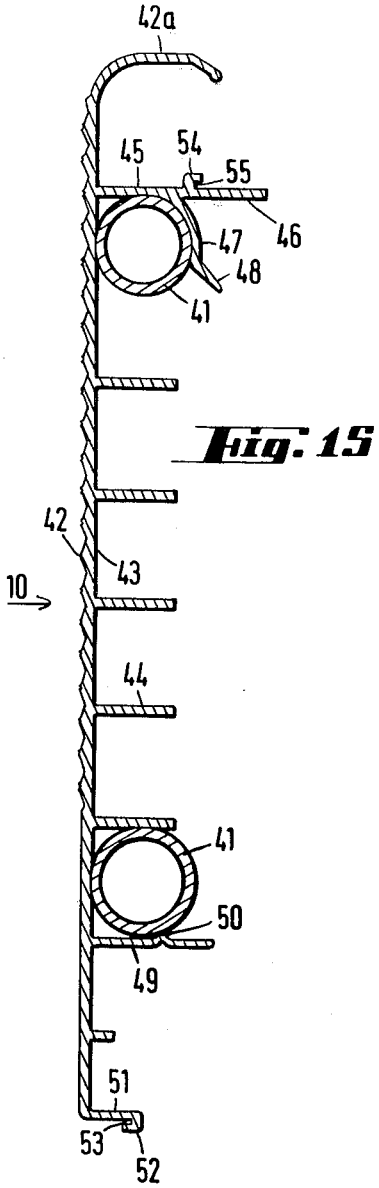
FIG. 15 is a cross-sectional view of a tread of a flight of stairs, said view showing an arrangement for fixing said tread.

FIG. 15 shows the profiled element used for the treads 10 of the stairway that are lying on two tubes indicated by the reference numeral 41. The upper or outer side indicated by the reference numeral 42 of the tread 10 is as usually provided with ribs or striations at least on its major surface area in order to be anti-skidding. The forward portion, indicated by the reference numeral 42*a*, of the tread is preferably turned downward as represented in the figure by a slightly rounded portion. The lower or inner side indicated by the reference numeral 43 of the tread 10 is provided as usually with a number of parallel flanges indicated by the reference numeral 44 that are transversal and perpendicular to the plane of the tread and make the tread more rigid. Two of said flanges, indicated respectively by the reference numerals 45 and 49, that are located near the longitudinal ends of the tread differ from the other flanges indicated by the reference numeral 44 in that the flange 45 is longer than the flanges 44 and is provided with an extension indicated by the reference numeral 46. Moreover, it is provided at the rearward directed side with a rounded portion indicated by the reference numeral 47 that covers approximately a quarter of the circle corresponding to the outer diameter of the tube 41, that is thus maintained by the lower or inner side 43 of the tread 10, the flange part 45 that is perpendicular to the tread and the rounded portion 47. As shown in FIG. 15, said rounded portion 47 is provided at its outer end with a short downward directed flap indicated by the reference numeral 48 that facilitates the hooking of the tread 10 to the tube 41. The other flange that differs from the flanges 44, i.e. the above-mentioned flange 49, located near the longitudinal rear end of the tread 10, is longer than the flanges 44 and is separated rearwardly from the last flange 44 of a distance just exceeding the length of the outer diameter of the tube 41, in order that the tube 41 may be maintained between said last flange 44 and flange 49; moreover, as may be seen in FIG. 15, the flange 49 is provided with a small boss indicated by the reference numeral 50 that directed toward the tube 41 in order to prevent said tube from going out again after having been forced between the last flange 44 and the flange 49.

In order to fix permanently the tread 10 to the tubes 41, the flange 49 may moreover be fixed by riveting here and there to the corresponding tube 41 (which is not shown in the drawing).

It will be easily understood that when mounting a tread 10 on the tubes 41, the tread will be firstly placed onto the forward tube 41 and then lowered onto the rearward tube 41.

Moreover, the profiled element that forms the tread 10 is preferably provided, as shown in FIG. 15 with means allowing to fix a rise of stair (not shown in the drawing), said means comprising on the one hand an additional flange indicated by the reference numeral 51 that is provided downward at the rear end of the tread 10 perpendicularly to the plane of the tread, said additional flange being provided with an outwardly bent portion that forms a right-angled hook indicated by the reference numeral 52, defining a longitudinal groove indicated by the reference numeral 53 that opens upward, the above mentioned means comprising on the other hand a right-angled hook indicated by the reference numeral 54 formed on the flange 45–46 on the side of said flange that is opposed to the side provided with the rounded portion 47, said right-angled hook 54 defining a longitudinal groove indicated by the reference numeral 55 that opens downward. A rise of stair (not shown in the drawing) formed of a simple plate will be slid into the groove 52 and bear against the flange 51 of a lower tread and it will be slid into the groove 55 and bear against the portion 46 of the flange 45–46 of an upper tread in such a way as to be securely maintained in its portion. For the rise of stair corresponding to the first tread from the bottom of a flight of stairs, the usual means of fixation to the tie-bars 16 or 17 at one of the longitudinal sides will be used.

Figure 17:
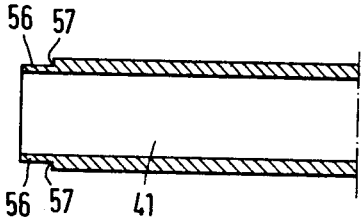
FIG. 17 is a longitudinal section view through this axis of the tube shown on FIG. 16 before its mounting.
Figure 16:
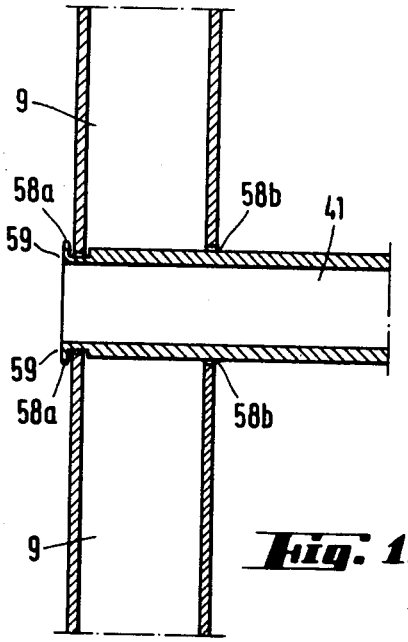
FIG. 16 is a longitudinal section view that shows the arrangement for fixing one of the tubes carrying the treads to a stringer of a flight of stairs.

FIG. 16 illustrates a preferred method of assembling each of the tubes 41 of a tread 10 to a stringer 9 (one of said tubes 41 being fixed to the section 9*a* of the stringer and the other tube 41 being fixed to the section 9*b* of said stringer). The tube 41 is longitudinally cut away at both ends, its thickness being thus reduced on a short distance, as indicated in 56, whereby the tube presents at each end a shoulder that is indicated by the reference numeral 57 (FIG. 17). After the tube 41 is introduced into the opening of the stringer 9, the part 58*a* of which (outer side) has a diameter slightly inferior to that of the part 58*b* (inner side), said parts 58*a* and 58*b* corresponding respectively to the cut away part of the outer diameter of the tube and to the part of normal diameter of said tube, whereby the shoulder 57 of the tube is maintained against the inner edge of the opening 58*a* in the stringer 9, the end 59 of the tube that projects beyond the stringer 9 is flanged by force on its whole periphery and the tube 41 is thus fixed permanently to the stringer 9; said fixing of the tube 41 to the stringer 9 may also be carried out on an usual way, for example by bolting.

The present invention is of course not limited to the specific embodiment described ans shown, and particularly certain details of the described assembly are not absolutely necessary for the realization of a stairway in accordance with the general principles of the invention, but they are nevertheless of interest as regards the rational character of the components, that make the stairway quite aesthetical and they allow to avoid a complicated mounting in situ that would require the use of cranes or other hoisting apparatuses, scaffoldings and the like and/or works such as welding, complicated hooking to the main or front wall of a building and so on . . . . The assembly in situ of a stairway in accordance with the present invention is carried out from the baseplate 13 of the stairway to a first level that corresponds to the lowest intermediate landing: first set of uprights 3 and tie-bars 15, 16, 24 and so on . . . , then from the first intermediate landing so mounted, the second one will be mounted and so on . . . .

As already mentioned above, the number of intermediate landings between two stories may vary, but it is also possible for reinforcing the column of support to provide additional supporting frames formed only of tie-bars 15 as well as other supporting means, such as stanchions, angle-irons and so on . . . and for example reinforcing angle-irons beneath the story landing; moreover, the arrangement of the treads 10 may be designed on another way than above described; rises of stairs may be optionally provided. The floor plates 11 and 12 as well as the treads 10 may be formed of gratings, thereby allowing flowing out water and dust (for instance sand).

What I claim is:

1. Outer metallic stairway, particularly made of aluminium, for multistage buildings, which is generally intended to be used for allowing the occupants of a multistage building to evacuate the building and persons to go out and/or to go in by an outside means, characterized in that it consists essentially of flights of stairs and landings fixed and supported by means of four uprights forming a column of support that are mounted vertically in a square or rectangular arrangement, the flights of stairs being fixed to at least two of the sides of the support column, the uprights being connected to one another at different levels and at least on the level of the landings by means of four horizontal tie-bars, one of which on a level with a story landing being extended beyond a second upright for supporting said landing on a whole side or to be fixed to an existing landing and to support the flight of stairs fixed to it that descends from said landing, and two of the four tie-bars that are provided on the level of an intermediate landing being extended beyond one of the uprights in order to form a part of the supporting frame of an intermediate landing, the flight of stairs descending from said intermediate landing being fixed to one of said two extended tie-bars.

2. Stairway according to claim 1, wherein the uprights forming the column of support are constituted by successive right-angled upright lengths that are placed end to end and that are connected to one another by the horizontal tie-bars.

3. Stairway according to claim 1 or claim 2, wherein the horizontal tie-bars are formed of two hollow sections having a general rectangular cross-section that are partially fitted in one another and each of the supporting frames of the intermediate landings and of the story landings are constituted by said horizontal tie-bars and by other identical horizontal tie-bars.

4. Stairway according to claim 3, wherein the horizontal tie-bars are cut to a chamfer at their ends and are connected to each other at the angles of the uprights by bolting to said uprights, at their intersection or crossing by fitting of each of the two sections forming a tie-bar astride the other, cut away portions being provided for this purpose, and at the outer corner of the landings by fitting of an angle piece into each of the two sections of the tie-bars and riveting of these to the angle piece.

5. Stairway according to claim 3, wherein the upper of the hollow sections with a general rectangular cross-section that constitute the tie-bars and the stringers has in profile a lower part slightly reduced in the form of a right-angled U and the lower one of said hollow sections with a general rectangular cross-section that constitute the tie-bars and the stringers ends at its upper part extending from its sides by a right-angled U that forms a right-angled notch for the right-angled U of the upper section, the lower one of said sections being moreover innerly reinforced at its lower part by a right-angled U.

6. Stairway according to claim 1 or claim 2, wherein a flight of stairs has two stringers which are constituted by two sections identical to the sections fitted in one another that form the tie-bars, sections also partially fitting in one another, the stringers being fixed by bolting at their upper part into a U-shaped element that is fixed to the side of an extended tie-bar of a landing frame and preferably at its lower part at least one of said stringers, the outer one, being fixed by bolting into a U-shaped element that is fixed to the edge of an extended tie-bar.

7. Stairway according to claim 1 or claim 2, wherein said landings and flights of stairs have balustrades comprising uprights which are formed of a hollow section having a rectangular cross-section that fits into the upper section of a tie-bar or of a stringer and is fixed thereto by riveting, and transverse elements which are fitted into the edge of the uprights and fixed by riveting.

8. Stairway according to claim 7, wherein the transverse elements of the balustrades of the flights of stairs are inversely bent at their upper part and at their lower part in order to fit perpendicularly along a straight line into the uprights of the balustrades of the flights of stairs.

9. Stairway according to claim 1 or claim 2, wherein a U-shaped element is fixed to the inner side of the upper part of the tie-bars of the landing frames, a floor-plate of the landing being placed on the outer side of the upper flange of said U-shape element.

10. Stairway according to claim 1 or claim 2, wherein the column of support rests on a base-plate to which it is fixed by bolting and the frame of the story landing is fixed by bolting to the main wall or front wall of the building.

11. Stairway according to claim 1 or claim 2, wherein said stairs comprise treads which are placed on two tubes themselves fixed to the stringers, said treads being provided at their lower or inner side with a number of parallel flanges that are perpendicular and transversal to the plane of the treads, two of said flanges which are near the longitudinal ends of the treads being on the one hand longer than the other ones and, on the other hand, one of said two flanges, which is at the forward part of the tread being provided at its rearward directed side with a rounded portion that covers approximately a quarter of the circle corresponding to the outer diameter of the tube whereby the corresponding tube is maintained at the same time by the lower or inner side of the tread, the perpendicular part of said flange and the rounded portion, and the other flange, which is at the rearward part of the tread, being spaced from the preceding flange, of a normal length, of a distance just exceeding the length of the outer diameter of the tube.

12. Stairway according to claim 11, wherein said rounded portion on the forward flange ends with a small flap which is directed downward and the extended rearward flange is provided with a boss on its forward directed side.

13. Stairway according to claim 11, wherein for the fixation of a rise of stair which is formed of a simple plate, the forward flange is provided at its forward directed side with a right-angled hook that defined a downward opening groove and the tread is provided at its rearward end with an additional perpendicular flange ending with a portion that is bent outwardly and constitutes a right-angled hook that defines an upward opening groove.

14. Stairway according to claim 11, wherein the tubes on which rest the treads are cut away at both ends on a part of their thickness, whereby the tube presents at each end a shoulder, and after the tube is introduced into openings provided to this end in the lateral side of the sections constituting the stringers, the outer opening being of a size just exceeding the length of the outer diameter of the cut away portion of the tubes, the outer end of the tube is flanged by force on its whole periphery.

* * * * *